United States Patent [19]

Jensen et al.

[11] Patent Number: 4,885,061

[45] Date of Patent: Dec. 5, 1989

[54] BRAKE HANGER SUSPENSION

[75] Inventors: Finn Jensen, Dolton; Rudolph E. Nadherny, Naperville, both of Ill.

[73] Assignee: Gerot-Pharmazeutika Gesellschaft m.b.H., Vienna, Austria

[21] Appl. No.: 597,936

[22] Filed: Apr. 9, 1984

[51] Int. Cl.[4] ..... F16D 65/14

[52] U.S. Cl. ..... 188/206 R; 403/373; 403/378; 188/209; 188/211

[58] Field of Search ..... 188/209, 211, 207, 206 R, 188/205 R; 403/378, 373; 24/573

[56] References Cited

U.S. PATENT DOCUMENTS

| | | | |
|---|---|---|---|
| 1,170,749 | 2/1916 | Harragin | 188/211 |
| 1,432,862 | 10/1922 | Huntoon | 188/211 |
| 1,513,519 | 10/1924 | Priebe | 188/209 |
| 2,169,729 | 8/1939 | Harbert | 188/209 |
| 2,276,781 | 3/1942 | Johnson | 188/209 |
| 2,278,785 | 4/1942 | Johnson | 188/209 |
| 2,295,739 | 9/1942 | Johnson | 188/209 |

*Primary Examiner*—Douglas C. Butler

*Attorney, Agent, or Firm*—Sughrue, Mion, Zinn, Macpeak & Seas

[57] ABSTRACT

A brake hanger suspension for suspending and securing a brake hanger between a pair of ears on a truck side frame of a railroad car wherein a pair of retainer blocks, between which the upper portion of the brake hanger extends, are locked together and between the ears by mating formations, and the resulting assembly locked together and in place by a U-shaped key or retainer.

3 Claims, 2 Drawing Sheets

BRAKE HANGER SUSPENSION

This invention relates generally to innovations and improvements in a brake hanger suspension for suspending a brake hanger on a truck side frame of a railroad car. More specifically, it relates to innovations and improvements in such a suspension wherein the upper portion of a brake hanger in the form of a loop extends through an opening formed between a pair of retainer blocks which are locked in a mating relationship between a pair of vertically-spaced ears extending from the truck side frame.

Certain types of railroad cars, as exemplified by railroad cars used for transporting trailers, make use of brake hangers so as to support a brake beam at its ends in the truck side frame. Accordingly, in such railroad car constructions there is a requirement for a brake hanger suspension. The present invention constitutes an improvement on known brake hanger suspensions as exemplified by the one shown and described in U.S. Pat. No. 2,172,976 dated Sept. 12, 1939.

The object of this invention, generally stated, is the provision of an improved brake hanger suspension and locking means for suspending and locking a brake hanger in the form of a loop between a pair of vertically-spaced and generally horizontally extending ears on a truck side frame of a railroad car wherein the upper portion of the brake hanger extends through an opening formed between a pair of retainer blocks which are matingly locked together between the ears in part by integrally formed interfitting formations on the ears and retainer blocks and in part by a removable locking key in the form of a U-shaped member.

Certain other and more specific objects of the invention will become apparent from the following detailed description of a preferred embodiment of the invention taken in connection with the accompanying drawings wherein.

Figure 1:
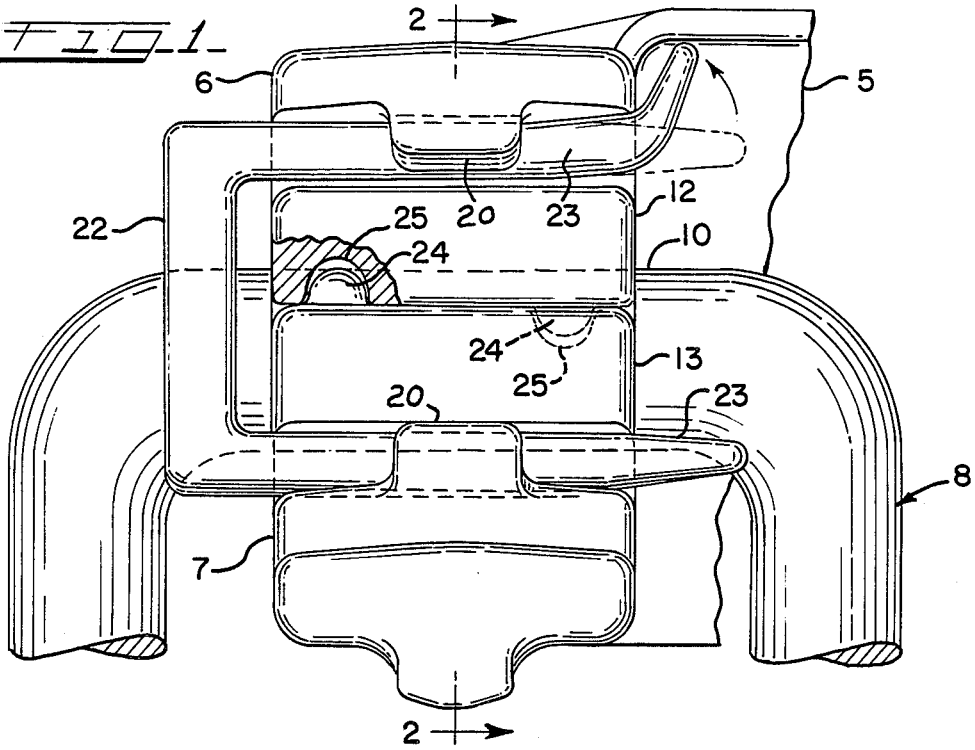
FIG. 1 is a fragmentary elevational view, partly broken away, of a truck side frame of a railroad car with a brake hanger suspension and locking means forming one embodiment of a present invention shown supporting the upper side of a brake hanger.

Referring to the drawings, in FIG. 1 a truck side frame of a railroad car is indicated at 5 from opposite ends of which project pairs of vertically-spaced ears or jaws 6 and 7 which are integrally formed with the truck side frame and disposed towards the wheels of the truck. While the ears or jaws 6 and 7 are preferably upwardly inclined, as shown, they can be considered to be generally horizontal. This general arrangement and formation is known and shown, for example, in the above-mentioned U.S. Pat. No. 2,172,976.

A brake hanger or link of known construction is indicated at 8 which is in the form of a closed loop. The upper side 10 of this brake hanger 8 extends through a horizontal opening 11 which is formed between a pair of retainer blocks 12 and 13. Preferably, the retainer blocks are identical so that either one can occupy the top or bottom mating position as shown in the drawings.

The top and bottom outer faces of the retainer blocks 12 and 13 respectively are provided with integral formations which mate or interfit with formations integrally formed on the opposing interior faces of the ears 6 and 7.

Figure 2:
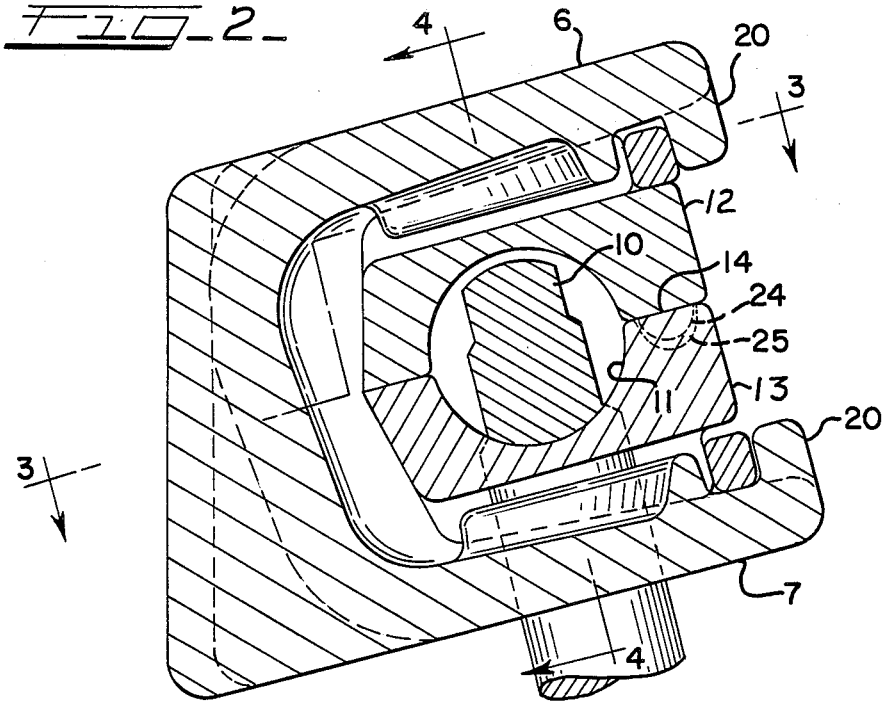
FIG. 2 is a vertical sectional view taken on line 2—2 of FIG. 1.

The inner mating surfaces of the retainer blocks 12 and 13 are planar as indicated at 14 in FIG. 2 with semicylindrical grooves formed therein which together form the opening 11. Preferably, each retainer block adjacent its outer or front end is provided on one side with an integrally formed projection 24 (FIG. 1) and a projection-receiving socket 25 on the other side. The projections 24—24 and sockets 25—25 are correspondingly located so as to interfit as shown in FIGS. 1 and 2. The projections 24 and sockets 25 facilitate the assembly of the retainer blocks 1, 2 and 3 into the jaws or ears 6 and 7.

The outer obverse faces or surfaces of the retainer blocks 12 and 13 have grooves or channels 15 formed therein which mate with the U-shaped lobes or ridges 16—16 (FIGS. 3 and 4) integrally formed on the inner opposing faces of the ears 6 and 7. On opposite sides of the channels 15 and the lobes 16, the outer surfaces of the retainer blocks 12 and 13 engage the corresponding inner surfaces of the ears 6 and 7 as indicated at 17—17 in FIG. 4. Thus, it will be seen that the outer faces of the retainer blocks 12 and 13 have formations which interfit or mate with the formations on the inner surfaces or faces of the ears 6 and 7 so as to properly retain the retainer blocks in engagement with one another and within the space between the ears 6 and and 7 as shown in the drawings. Preferably, the inner faces of the ears on jaws 6 and 7 tend to converge from their outer or distal ends towards their inner or proximal ends, thereby facilitating the insertion and retention of the retainer blocks 12 and 13.

The lips of the ears 6 and 7 have integrally formed on the distal ends thereof inwardly projecting and opposing protruberances or bosses 20—20. The dimensions of the bosses 20 are such as to allow insertion of the retainer blocks 12 and 13 with the channels 15 accomodating the bosses. The inside faces of the protruberances 20 are beveled as indicated at 21—21 (FIG. 3) and spaced from the front or outer end surfaces of the formations 16 and of the retainer blocks 12 and 13 so as to receive therebetween the legs 23—23 of a U-shaped key or retainer 22.

Figure 3:
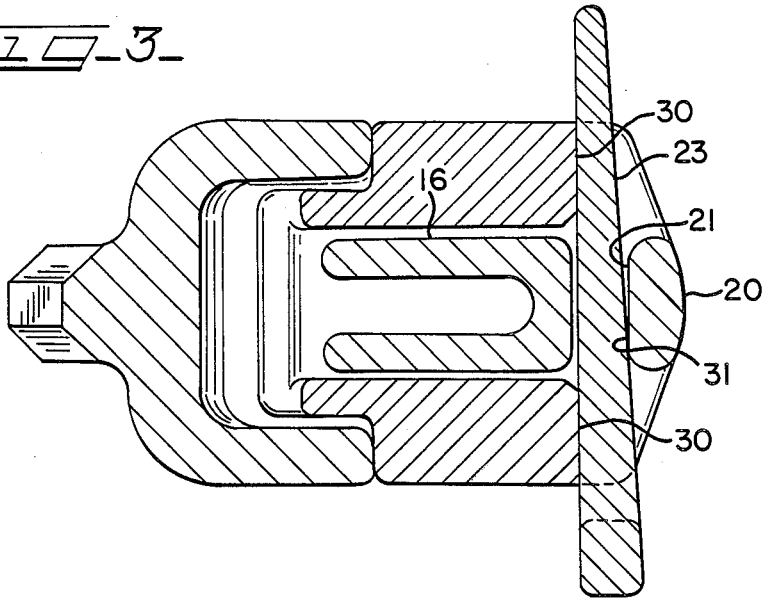
FIG. 3 is a sectional view taken on line 3—3 of FIG. 2.
Figure 4:
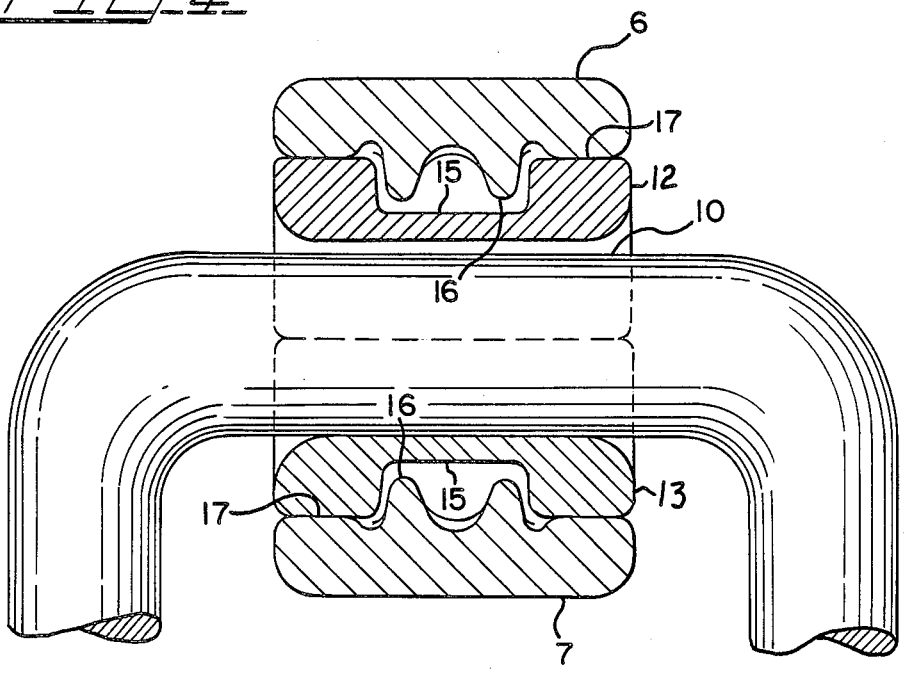
FIG. 4 is a sectional view taken on line 4—4 of FIG. 2.

The key 22 serves to lock and secure together the retainer blocks 12 and 13 as assembled within the space between the ears 6 and 7. The opposing parallel legs 2 and 3 of the retainer 22 are tapered from the bight portion of the distal ends thereof. The key or retainer 22 is so dimensioned as to be easily inserted from either side of the assembly into the upper and lower spaces between the inner surfaces 21 of the projections 20 and the end surfaces of the retainer blocks 12 and 13 and the lobe formation 16, as shown in FIGS. 1-3. It will be appreciated that the tapers on the legs 23—23 of the key allow the key to be driven or wedged into place in a secure manner. The angles of the beveled surfaces 21—21 and the taper of the legs 23-23 are such that one side surface of each leg 23 will fit flatwise against the end surfaces on the outer ends of the retainer blocks 12 and 13 as indicated at 30—30 (FIG. 3) while the opposite side of each leg 23 fits flatwise against one of the beveled surfaces 21 on a protruberance 20 as indicated at 31.

Further securement of the assembly and of the key 22 in the position shown is obtained by bending one or both of the distal ends of the legs 23 as shown in FIG. 1. It will be appreciated that if it becomes necessary to remove a key 22, each bent distal end on a leg 23 can be straightened.

It will be apparent to those skilled in the art that certain changes may be made in the foregoing embodiment of the invention without departing from the spirit and scope of the appended claims. For example, the U-shaped key or retainer 22 can be replaced with two separate pins corresponding to the legs 23—23.

What is claimed is:

1. In a brake hanger suspension for suspending and securing a brake hanger in the form of a loop between a pair of vertically spaced generally horizontally extending ears on a truck side frame of a railroad car wherein the upper portion of the brake hanger extends through a horizontal opening formed between a pair of retainer blocks locked matingly together between said ears, the improvement which comprises first formations integrally formed on the inner opposing faces of said ears, second formations integrally formed on the outer faces of said retainer blocks which mate with said first formations, third formations integrally formed on the insides of the lips of said ears so as to project toward each other with the rear sides of said third formations being spaced from the front ends of said first and second formations, and locking means providing a pair of legs which extend through the spaces between said rear sides of said third formations and the front ends of said first and second formations, each of said first formations being in the form of a U-shaped lobe, each of said second formations being provided by channels on the outer faces of said retainer blocks, each U-shaped lobe fitting in the channel in the adjacent retainer block, and each of said third formations being in the form of aligned protruberances on the insides of said lips, and said channels of said second formations allowing said retainer blocks to pass by said protruberances when being inserted into place between said ears.

2. In a brake hanger suspension as called for in claim 1, said locking means being a U-shaped locking key, and the legs of said U-shaped locking key being tapered toward their distal ends.

3. In a brake hanger suspension as called for in claim 1, said inner or rear sides of said third formations being beveled in opposite directions to provide oppositely inclined bevel surfaces which facilitate said locking means being inserted from opposite sides of said hanger, and said legs of said locking means being tapered and the angles of said bevels on the inner or rear sides of said third formations such that when each leg is in place one side surface thereof fits flatwise against the outer or front ends of said second formations while the opposite side surface thereof fits flatwise against one of said bevel surfaces thereby providing a wedging and retaining action on said legs.

* * * * *

UNITED STATES PATENT AND TRADEMARK OFFICE

CERTIFICATE OF CORRECTION

PATENT NO. : 4,885,061

DATED : December 5, 1989

INVENTOR(S) : Finn Jensen and Rudolph E. Nadherny

It is certified that error appears in the above-identified patent and that said Letters Patent is hereby corrected as shown below:

Title page, after "Assignee", delete "Gerot-Pharmazeutika Gesellschaft m.b.H., Vienna, Austria" and insert --Ireco, Inc., Chicago, Illinois--.

Title page, after "Attorney, Agent, or Firm", delete "Sughrue, Mion, Zinn, Macpeak & Seas" and insert --Lockwood, Alex, FitzGibbon & Cummings--.

Signed and Sealed this

Twenty-fifth Day of June, 1991

*Attest:*

*Attesting Officer*

HARRY F. MANBECK, JR.

*Commissioner of Patents and Trademarks*